US006785501B2

(12) United States Patent
Hongawa et al.

(10) Patent No.: US 6,785,501 B2
(45) Date of Patent: Aug. 31, 2004

(54) TRANSFER-AND-FIXATION SYSTEM WITH PREHEATED PRINTING MEDIUM FOR CREATING IMAGES USING LIQUID-DEVELOPMENT ELECTROPHOTOGRAPHIC APPARATUS

(75) Inventors: Hironaga Hongawa, Uchinada-machi (JP); Satoshi Sakai, Kanazawa (JP); Eri Yamanishi, Hakui (JP); Isao Nagata, Tsubata-machi (JP); Shigeharu Okano, Hakui (JP); Yutaka Nakashima, Kanazawa (JP); Tadashi Nishikawa, Tsubata-machi (JP); Akihiko Inamoto, Uchinada-machi (JP); Satoshi Miyamoto, Hakui (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 10/344,927

(22) PCT Filed: Mar. 29, 2002

(86) PCT No.: PCT/JP02/03143

§ 371 (c)(1),
(2), (4) Date: Feb. 19, 2003

(87) PCT Pub. No.: WO02/082189

PCT Pub. Date: Oct. 17, 2002

(65) Prior Publication Data

US 2003/0190174 A1 Oct. 9, 2003

(30) Foreign Application Priority Data

Apr. 3, 2001 (JP) ..... 2001-104093
Apr. 10, 2001 (JP) ..... 2001-110729

(51) Int. Cl.[7] ..... G03G 15/16; G03G 15/20
(52) U.S. Cl. ..... 399/307
(58) Field of Search ..... 399/307; 219/216

(56) References Cited

U.S. PATENT DOCUMENTS 6,487,389 B2 * 11/2002 Jia et al. ..... 399/327

FOREIGN PATENT DOCUMENTS

| | | |
|---|---|---|
| JP | 57-163264 | 10/1982 |
| JP | 59-77467 | 5/1984 |
| JP | 9-6066 | 1/1997 |
| JP | 2000-56575 | 2/2000 |
| JP | 2000-321923 | 11/2000 |
| WO | WO 2/17825 | 10/1992 |

* cited by examiner

*Primary Examiner*—Quana Grainger

(57) ABSTRACT

In the present invention, a toner image produced through a development process of supplying a liquid toner onto an image bearing body bearing an electrostatic latent image is transferred from the image bearing body onto an intermediate transfer body and then transferred from the intermediate transfer body onto a printing medium by use of a backup roller in a transfer-and-fixation zone. The printing medium is preheated to a temperature required for transfer and fixation before the printing medium reaches the transfer-and-fixation zone. No heating means is provided in the transfer-and-fixation zone, and the intermediate transfer body and the backup roller are pressed against each other at a high pressure ranging from 10 kg/cm$^2$ to 60 kg/cm$^2$. Alternatively, the intermediate transfer body is provided with heating means; resin for use in the liquid toner has a softening temperature not higher than withstand temperatures of members other than the intermediate transfer body such as a photosensitive drum; and the intermediate transfer body is heated to a temperature not lower than the softening temperature of the resin and not higher than the withstand temperatures of the other members.

16 Claims, 13 Drawing Sheets

Correction Table

| Types of Media | Thermal Conductivity | Heat Quantity Correction Value |
|---|---|---|
| Low Grade Paper | 1.3 | -1 |
| Medium Grade Paper | 1.5 | 0 |
| Wood Free Paper | 1.6 | +2 |
| OHP Sheet | 2.5 | +5 |
| . | . | . |
| . | . | . |
| Art Paper | 2.0 | +3 |

Preheating Control (A)

Results of Experiment on Relationship between Transfer Pressure and Transfer Efficiency

| Pressure [kgf/cm²] | Transfer Efficiency [%] |
|---|---|
| 1 | 73.5 |
| 3 | 83.5 |
| 5 | 95.7 |
| 10 | 99.2 |
| 20 | 99.5 |
| 30 | 100 |
| 40 | 100 |
| 50 | 100 |
| 60 | 100 |
| 70 | 100 |
| 80 | 100 |

(B)

TRANSFER-AND-FIXATION SYSTEM WITH PREHEATED PRINTING MEDIUM FOR CREATING IMAGES USING LIQUID-DEVELOPMENT ELECTROPHOTOGRAPHIC APPARATUS

TECHNICAL FIELD

The present invention relates to a transfer-and-fixation system for a liquid-development electrophotographic apparatus for transferring a toner image from an intermediate transfer roller onto a printing medium and fixing the transferred toner image on the printing medium, by use of a backup roller.

BACKGROUND ART

In a liquid-development electrophotographic apparatus, a melt transfer system for fixing a toner image on a printing medium is desirably performed such that, when toner particles are to be brought into contact with the printing medium for transfer onto the medium, the toner particles and the medium have a temperature not lower than the melting temperature of toner particles. In the course of transfer, a backup force is applied to the back side of the medium so as to establish close contact between the toner particles and the medium, whereby the molten toner particles are transferred onto the medium by means of adhesion thereof.

Conventionally, as shown in FIG. 24, in a melt transfer-and-fixation system where toner is melted, and the molten toner is transferred onto and fixed on paper by means of adhesion thereof, in order to increase transfer efficiency and fixation strength, the temperature of a transfer roller and that of a backup roller must be set sufficiently high (e.g., 150° C.) in relation to the melting temperature of toner.

Heating an intermediate transfer belt, which has good releasability (low surface energy), to high temperature, as shown in FIG. 3, causes toner cohesion to drop greatly, so that the difference between toner cohesion and the surface energy of the intermediate transfer belt becomes small; as a result, surface tension thins toner image.

Further, before a toner image is transferred onto the intermediate transfer belt, the intermediate transfer belt must be cooled in order to protect members which come into contact with the intermediate transfer belt (e.g., a photosensitive drum) from heat and to prevent defective transfer which would otherwise result from melting of toner. In order to cope with such problems, conventionally, the intermediate transfer belt is cooled by use of a cooling unit such as a cooling fan, and a thin intermediate transfer belt has been employed for reducing the thermal capacity thereof.

However, in view of strength retention and other factors, the thickness of the belt can be reduced at most to about 50 $\mu$m. Therefore, the thermal capacity of the belt cannot be sufficiently minimized, thereby causing substantial amount of energy to be consumed for cooling.

FIG. 25 shows a known structure of an intermediate transfer body (disclosed in Japanese Patent Application Laid-Open (kokai) No. 2000-56575). The intermediate transfer body assumes the form of a roller and includes a rigid drum which serves as a core thereof and is made of metal such as aluminum. The drum is electrically conductive so as to allow application thereto of voltage from, for example, a shaft thereof for electrostatically transferring a toner image from a photosensitive body onto the intermediate transfer body. Also, the drum has hardness suited for application of a pressure required for melt-transferring toner particles, which have been transferred onto the intermediate transfer roller, onto medium such as paper. On the drum, an elastic body layer which is electrically conductive and resistant to heat is formed. On the elastic body layer, a high-stiffness surface layer which is electrically conductive and resistant to heat and has appropriate releasability and preferably resistance to silicone oil is formed.

The high-stiffness surface layer is, for example, a heat resistant, electrically conductive polyimide film having a thickness of about 10–50 $\mu$m coated with fluorosilicone rubber and functions to reduce expansion and contraction of the intermediate transfer body.

However, high-stiffness materials (e.g., polyimide) which has been conventionally used for a surface layer of an intermediate transfer body in a color electrophotographic apparatus are expensive.

DISCLOSURE OF THE INVENTION

The present invention has been accomplished in view of the foregoing, and an object of the invention is to ensure high transfer efficiency through enhancement of toner cohesion and toner adhesion to paper, while maintaining members (such as a photosensitive drum) which come into contact with an intermediate transfer roller at a temperature not higher than the withstand temperatures of the members, to thereby eliminate the need to cool the members for protection from heat.

Another object of the present invention is to carry out printing with high image quality by maintaining toner cohesion on the intermediate transfer roller having good releasability at a sufficiently high level as compared with surface energy of the intermediate transfer roller, to thereby avoid thinning an image.

Yet another object of the present invention is to provide an inexpensive intermediate transfer body layer structure with high stiffness that is suitably applicable to an intermediate transfer roller without the use of expensive surface layer material.

In a transfer-and-fixation system for a liquid-development electrophotographic apparatus of the present invention, a toner image produced through a development process of supplying a liquid toner onto an image bearing body bearing an electrostatic latent image is transferred from the image bearing body onto an intermediate transfer body and then transferred from the intermediate transfer body onto a printing medium by use of a backup roller in a transfer-and-fixation zone. The system is characterized in that the intermediate transfer body and the backup roller are pressed against each other at a high pressure ranging from 10 kg/cm$^2$ to 60 kg/cm$^2$; no heating means is provided in the transfer-and-fixation zone; and the printing medium is preheated to a temperature required for transfer and fixation before the printing medium reaches the transfer-and-fixation zone.

In the transfer-and-fixation system for a liquid-development electrophotographic apparatus of the present invention, resin for use in the liquid toner has a softening temperature not higher than the withstand temperatures of members other than the intermediate transfer body such as a photosensitive drum, and the intermediate transfer body is provided with heating means for heating the intermediate transfer body to a temperature not lower than the softening temperature of the resin and not higher than the withstand temperatures of the other members. Also, the printing medium is preheated to a temperature required for transfer and fixation before the printing medium reaches the transfer-and-fixation zone.

Further, an intermediate transfer body suited for use in such a transfer-and-fixation system is characterized by including a tension textile layer which has undergone a stretching process effected in a direction of rotation of the intermediate transfer body, so as to enhance stiffness in expansion and contraction of the intermediate transfer body, and in that an image bearing layer is formed on the surface of the tension textile layer.

BEST MODE FOR CARRYING OUT THE INVENTION

Figure 1:
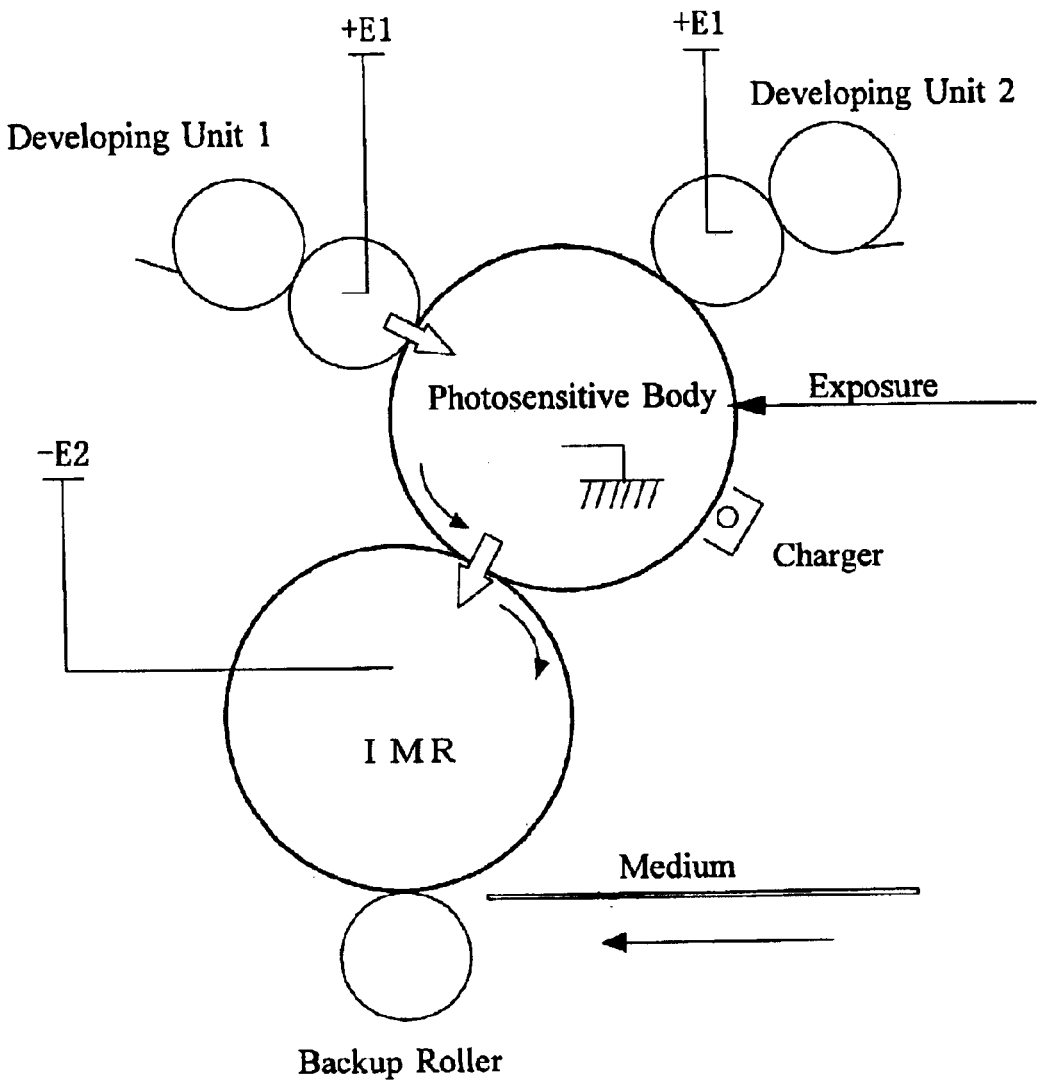
FIG. 1 is a view showing the overall configuration of an electrophotographic apparatus which uses a liquid toner and to which the present invention is applicable.

Embodiments of the present invention will next be described in detail. FIG. 1 shows the schematic configuration of an electrophotographic apparatus which uses a liquid toner and to which the present invention is applicable. As illustrated, the electrophotographic apparatus includes, as main component members, a photosensitive body, a charger, an exposure unit, developing units corresponding to colors (only two developing units are illustrated), an intermediate transfer body IMR, and a backup roller.

The charger electrostatically charges the photosensitive body to about 800 V. The exposure unit exposes the photosensitive body to a laser beam having a wavelength of 780 nm, whereby an electrostatic latent image is formed on the photosensitive body such that an exposed portion of the photosensitive body assumes an electric potential of about 100 V.

The developing units are usually provided in correspondence with yellow, magenta, cyan, and black. The developing units are biased at about 400–600 V (E1) and form a toner layer having a thickness of about 5–10 $\mu$m on each of corresponding developing rollers by use of a liquid toner having a toner viscosity of 100–10000 mPa·S and a carrier viscosity of 50 cSt. The developing rollers supply positively charged toner particles to the photosensitive body according to respective electric fields established between the developing rollers and the photosensitive body, whereby the toner particles adhere to exposed portions (or unexposed portions) of the photosensitive body, which are electrostatically charged at about 100 V.

The intermediate transfer body IMR is biased at about −300 V (E2), whereby toner is transferred onto the intermediate transfer body IMR from the photosensitive body according to an electric field established between the intermediate transfer body IMR and the photosensitive body. Transfer of toner onto the intermediate transfer body IMR from the photosensitive body is sequentially performed, for example, in the following sequence: first, transfer of a yellow toner; next, transfer of a magenta toner; then, transfer of a cyan toner; and finally, transfer of a black toner.

As will be described later in detail, toner adhering to the intermediate transfer body IMR is transferred onto and fixed on printing paper while sufficient fixation strength is secured by preheating the printing paper before transfer and by imposing high pressure to the toner by means of the backup roller. The preheating of the printing paper imparts required thermal energy for fixation to the printing paper, without involvement of application of heat to the toner from the intermediate transfer body and the backup roller.

Figure 2:
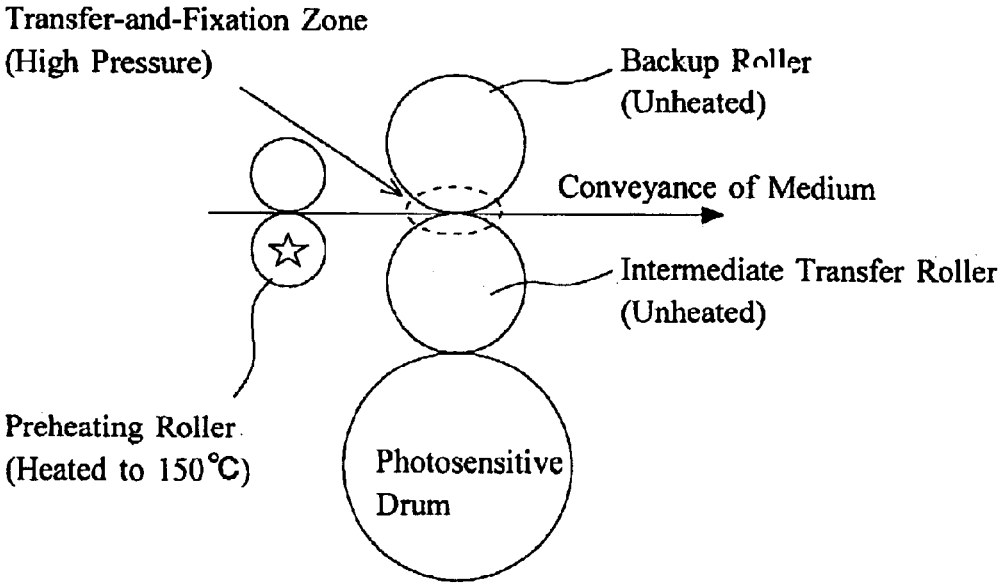
FIG. 2 is a view showing a first embodiment of a transfer-and-fixation system configuration to which the present invention is applicable.
Figure 3:
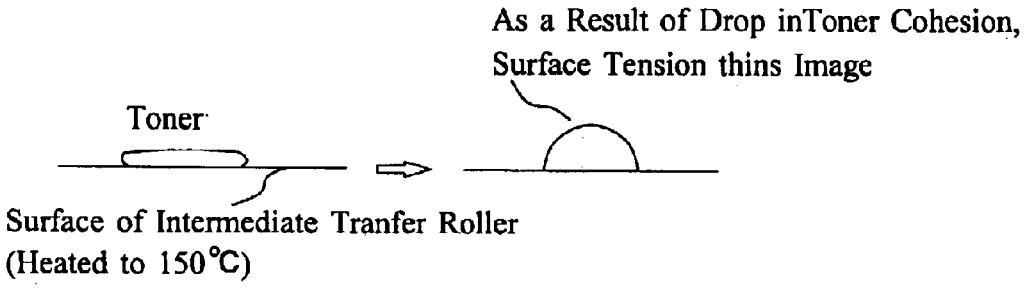
FIG. 3 is a view for explaining that an image is thinned by surface tension.

FIG. 2 shows a first embodiment of a transfer-and-fixation system configuration to which the present invention is applicable. In the first embodiment, the backup roller does not have a heating unit, and no heating means is provided for the intermediate transfer roller for heating toner on the intermediate transfer roller before the toner reaches a transfer-and-fixation zone. The intermediate transfer roller and the backup roller are pressed against each other at a high pressure ranging from 10 kg/cm$^2$ to 60 kg/cm$^2$, thereby enhancing toner cohesion and adhesion of toner to a printing medium to thereby attain 100% transfer.

Figure 9:
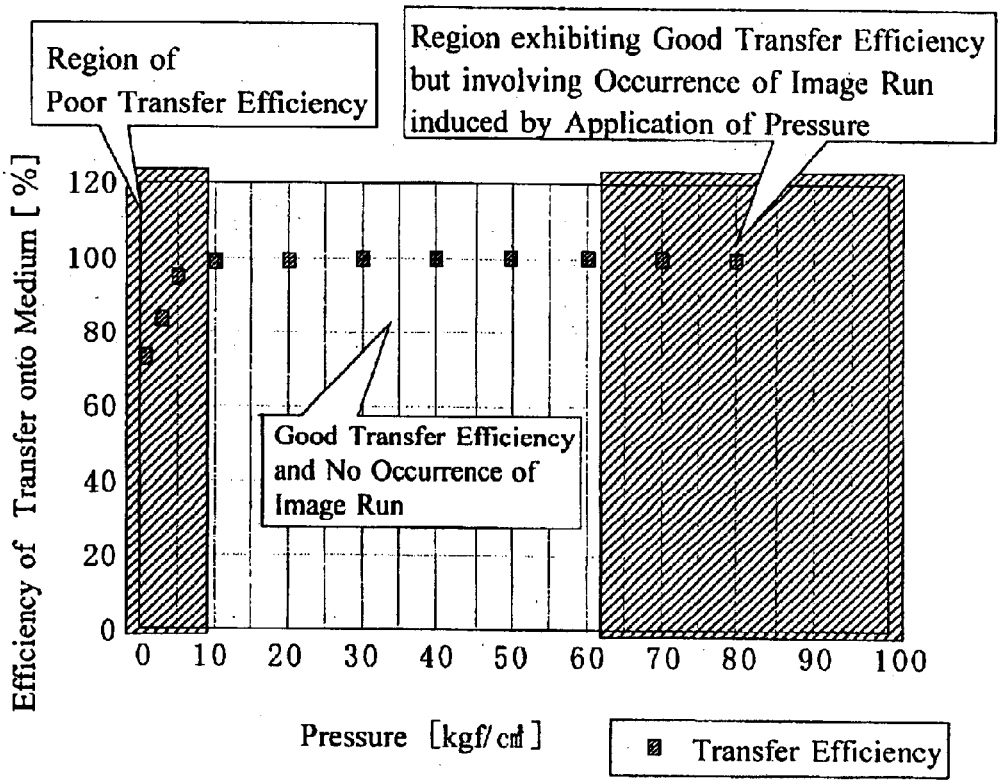
FIG. 9(A) is a table showing the results of experiment on the relationship between transfer pressure and transfer efficiency.
FIG. 9(B) is a graph showing the results.

FIG. 9 shows the results of an experiment on the relationship between transfer pressure and transfer efficiency, wherein (A) is a table showing the results, and (B) is a graph showing the results. As shown in FIG. 9, transfer efficiency increases with pressure. Transfer efficiency exceeds 99% at a pressure of 10 kgf/cm$^2$. However, at a pressure in excess of 60 kgf/cm$^2$, image run arises.

Figure 4:
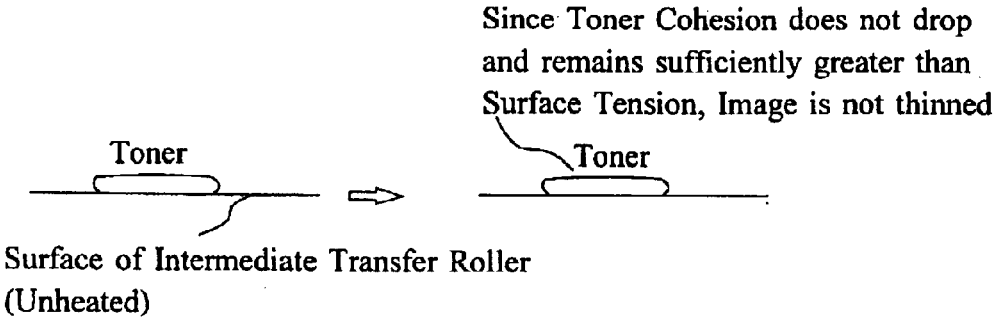
FIG. 4 is a view for explaining that an image is not thinned by surface tension.

The printing medium is heated to a temperature required for fixation before transfer is performed, whereby reliable fixation is attained by means of energy of the heating and high pressure applied in a transfer zone. This eliminates the need to employ cooling to thermally protect members in contact with the intermediate transfer body such as a photosensitive drum and the need to employ, for example, a thin belt, which has been conventionally employed to effect cooling, thereby simplifying structure and reducing cost. Further, on an intermediate transfer roller having good releasability (low surface energy), toner cohesion does not drop and remains sufficiently great as compared with surface energy of the intermediate transfer roller, thereby, as shown in FIG. 4, avoiding image thinning which would otherwise result from surface tension.

Thermal energy density (heat quantity per unit thickness) required for melting and fixing toner is constant. Therefore, when the heat quantity to be applied for preheating is set for a thick printing medium, the heat quantity becomes excessive for preheating a thin printing medium. When K represents thermal energy density required for melting and fixing toner, and L1 and L2 represent the thickness of thick paper and thin paper, respectively, which serve as printing media, thermal energy required for preheating is represented by $$\text{Thick paper: } K \times L1 > \text{thin paper: } K \times L2$$

By means of varying preheating temperature (and preheating time) according to the thickness (which is obtained from preset data or through detection) of a printing medium, the optimum thermal energy can be applied to the printing medium at all times, thereby conserving energy.

Figures 7, 8:
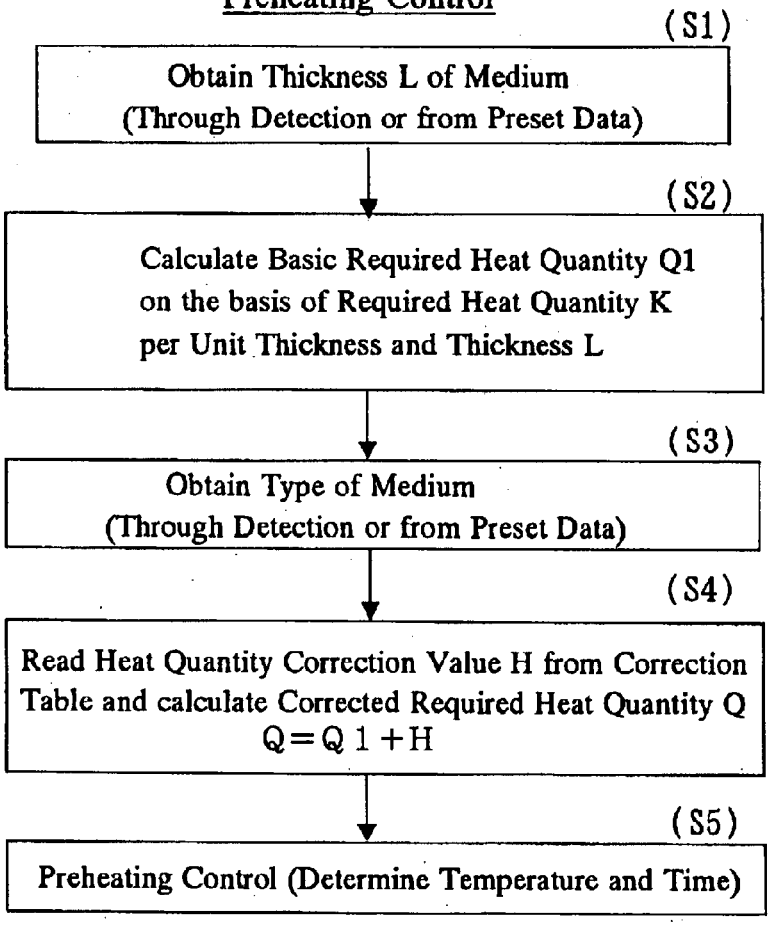
FIG. 7 is a table which lists thermal conductivities of different types of media.
FIG. 8 is a flowchart for explaining control of preheating for a printing medium.

A correction table which lists thermal conductivities of different types of media as shown in FIG. 7 is stored in a printer driver; and preheating temperature (and preheating time) is corrected with reference to the correction table so as to apply the optimum thermal energy to a printing medium, thereby conserving energy.

Control for printing medium preheating will next be described with reference to FIG. 8. First in step (S1), the thickness L of a printing medium is obtained through detection or from a preset value. On the basis of the required heat quantity per unit thickness K and the obtained thickness L, a basic required heat quantity Q1 is calculated as Q1=K×L (S2). In step (S3), the type of a printing medium is obtained through detection or from the preset data. On the basis of the obtained printing medium type, a heat quantity correction value H is read from the correction table. By use of the obtained heat quantity correction value H, a corrected required heat quantity Q is calculated as Q=Q1+H (S4). On the basis of the calculated required heat quantity Q, temperature and time are determined to thereby control preheating (S5).

Figure 5:
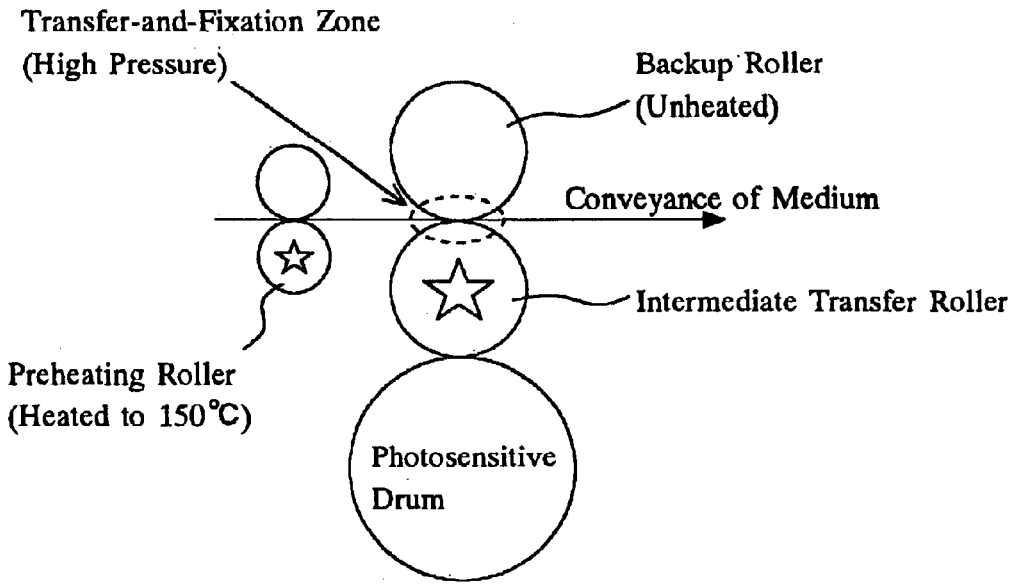
FIG. 5 is a view showing a second embodiment of a transfer-and-fixation system configuration to which the present invention is applicable.

FIG. 5 shows a second embodiment of a transfer-and-fixation system configuration to which the present invention is applicable. In the second embodiment, the backup roller does not have a heating unit, but the intermediate transfer roller has a heating means for heating the intermediate transfer roller to a relatively low temperature (e.g., 60° C.). Also, as in the case of the first embodiment, the intermediate transfer roller and the backup roller are pressed against each other at high pressure, and the printing medium is heated to a temperature required for fixation before transfer is performed.

Resin for use in toner has a softening temperature (TG) not higher than the withstand temperatures of members other than the intermediate transfer roller such as the photosensitive drum. The heating means provided in the intermediate transfer roller is set to heat the intermediate transfer roller to a temperature greater than the softening temperature (TG) of the resin and lower than the withstand temperatures of the other members. By so doing, while no need to cool the intermediate transfer roller is maintained, the toner assumes a semi-cohesion state, thereby facilitating transfer onto the printing medium. Therefore, as compared with the first embodiment, preheating temperature for the printing medium can be set low, and pressure to be applied in an intermediate transfer roller section can be set low.

Figure 6:
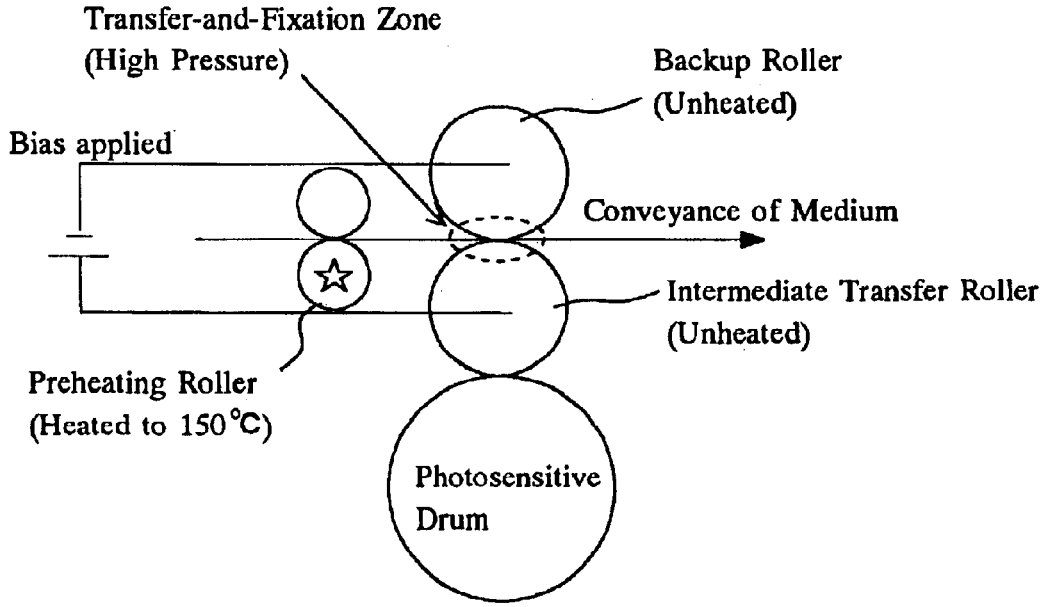
FIG. 6 is a view showing a third embodiment of a transfer-and-fixation system configuration to which the present invention is applicable.

FIG. 6 shows a third embodiment of a transfer-and-fixation system configuration to which the present invention is applicable. As in the case of the first embodiment, the backup roller and the intermediate transfer roller do not have a heating unit; the intermediate transfer roller and the backup roller are pressed against each other at high pressure; and the printing medium is heated to a temperature required for fixation before transfer is performed.

In the illustrated third embodiment, bias is applied between the intermediate roller and the backup roller in a direction along which toner can move. Since the application of bias facilitates transfer of toner onto the printing medium, as compared with the first embodiment, preheating temperature for the printing medium can be set low, and pressure to be applied in an intermediate transfer roller section can be set low.

Such bias application means can be combined with the above-described second embodiment shown in FIG. 5 to thereby facilitate transfer of toner onto the printing medium, whereby preheating temperature for the printing medium can be set low, and pressure to be applied in an intermediate transfer roller section can be set low.

Next, structures applicable to an intermediate transfer body will be described with reference to FIGS. 10 to 23. The structures to be exemplified below are applicable not only to an intermediate transfer body assuming a roller form, but also to that assuming a belt form. In application to an intermediate transfer body in a roller form, the exemplified structures can be embodied such that a surface layer is formed, directly or via an elastic body layer, on a rigid drum made of metal such as aluminum. In application to an intermediate transfer body in a belt form, the exemplified structures can be embodied in the form of a belt.

Figure 10:
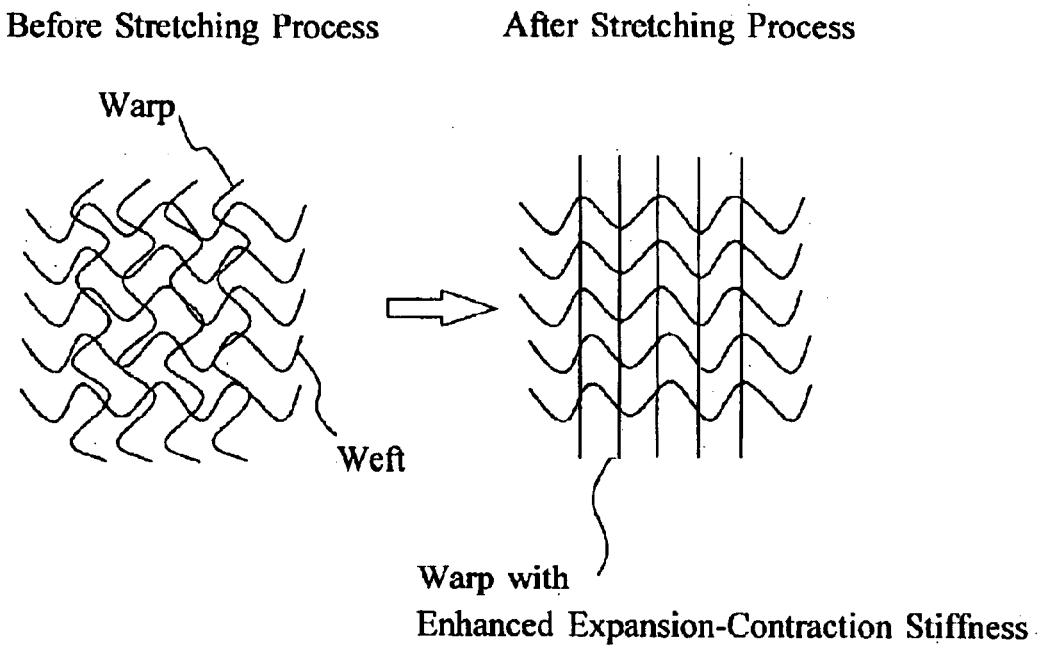
FIG. 10 is a view for explaining a tension textile layer for use in an intermediate transfer body.

FIG. 10 is a view for explaining a tension textile layer for use in an intermediate transfer body. A textile before it undergoes a stretching process is shown at the left of FIG.

10, and the textile which has undergone the stretching process to become a tension textile layer is shown at the right of FIG. 10. A textile formed of woven warp and weft (e.g., a cotton textile) undergoes a stretching process, which is effected in the expansion-and-contraction direction of an image on an intermediate transfer body (i.e., in the direction of rotation of the intermediate transfer body), to thereby become a tension textile layer for enhancing stiffness in expansion and contraction of the intermediate transfer body.

Figure 11:
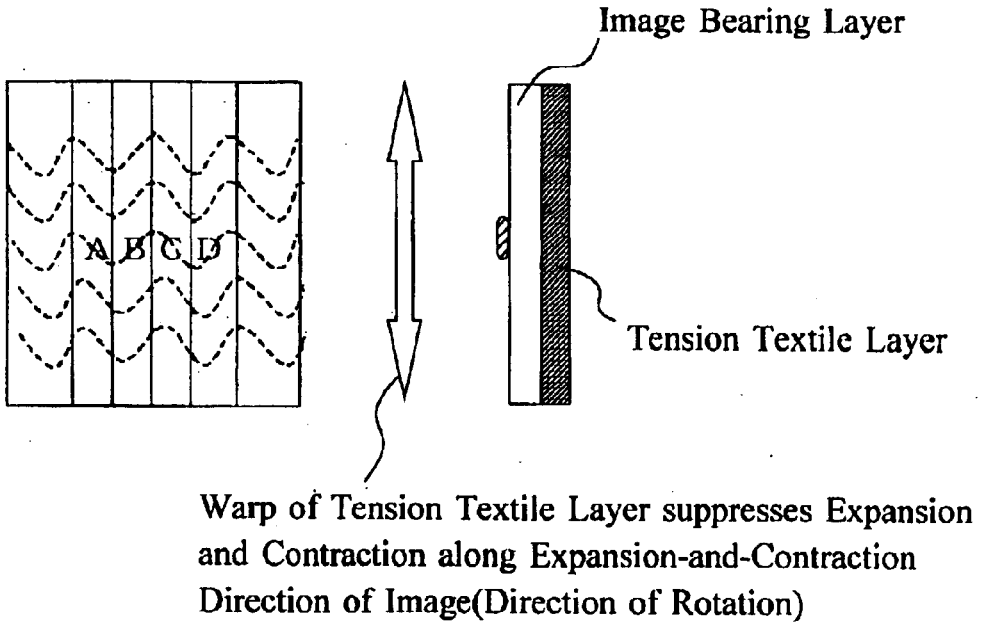
FIG. 11 is a view showing an intermediate transfer body including a tension textile layer.

FIG. 11 shows an intermediate transfer body including such a tension textile layer. An image bearing layer is affixed on the tension textile layer to thereby form a surface layer of the intermediate transfer layer. The warp of the textile which has undergone a stretching process suppresses expansion and contraction of an image, thereby allowing highly accurate superposition of images. Since an expensive high-stiffness material (e.g., polyimide) is not used, an inexpensive intermediate transfer body having high stiffness can be provided.

Figure 12:
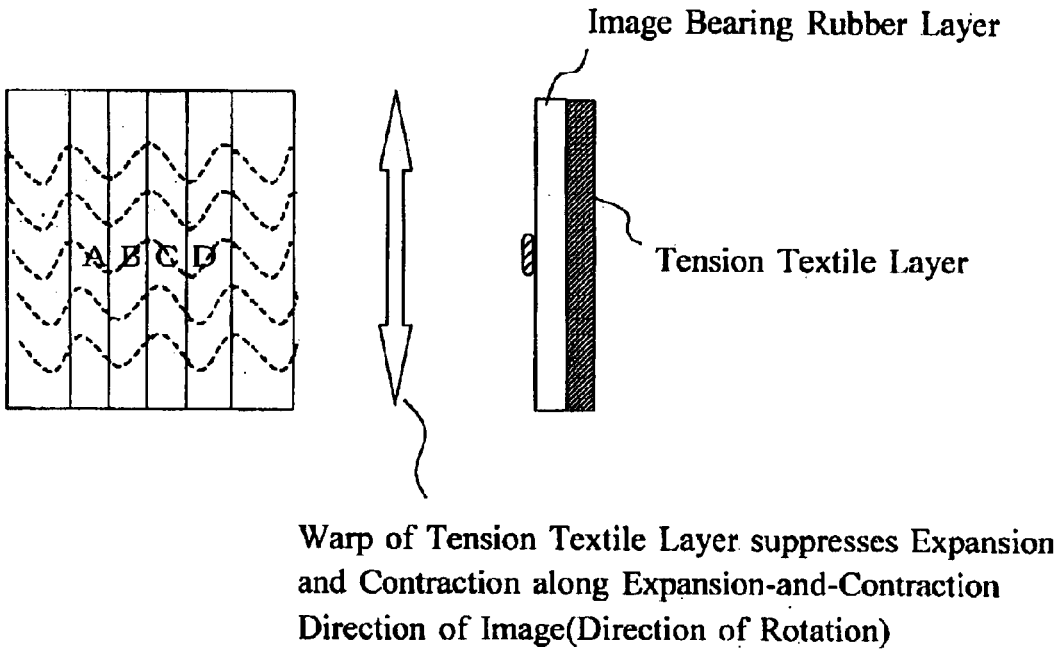
FIG. 12 is a view showing a structure which uses a layer of elastic rubber as an image bearing layer of FIG. 11.

FIG. 12 shows a structure which uses a layer of elastic rubber (JIS-A10 to -A80) as the image bearing layer of FIG. 11. This structure stabilizes contact of the intermediate transfer body with a photosensitive drum, thereby enabling reliable formation of an image. Even when elastic rubber is used, the tension textile layer suppresses expansion and contraction of an image, whereby an image can be stably formed with high accuracy.

Figure 13:
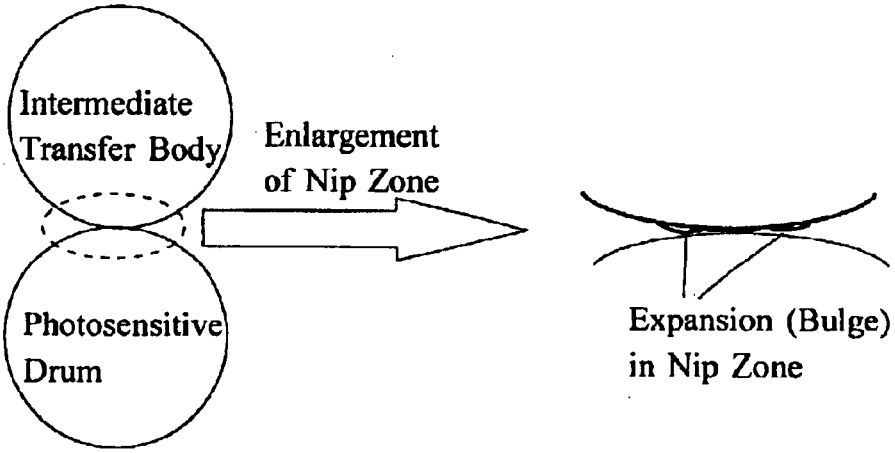
FIG. 13 is a view showing a nip state in a nip zone between the intermediate transfer body of FIG. 12 and a photosensitive drum.

FIG. 13 shows a nip state in a nip zone between the intermediate transfer body of FIG. 12 and a photosensitive drum. In the case where a layer of elastic rubber is used as an image bearing layer, application of high pressure (not less than about 3 kgf/cm$^2$) for further stabilization of contact may cause an expansion of the surface rubber layer called bulge in the nip zone.

Figure 14:
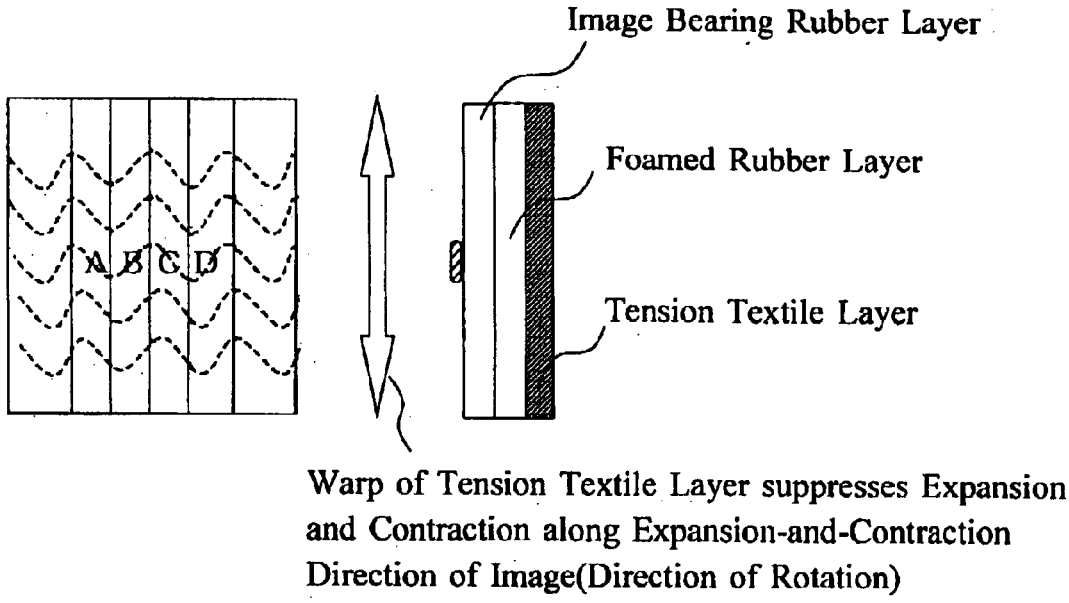
FIG. 14 is a view showing an intermediate transfer body which includes a foamed rubber layer for suppressing bulge.

FIG. 14 shows an intermediate transfer body which includes a foamed rubber layer for suppressing the above-mentioned bulge. Through disposition of the foamed rubber layer under an image bearing rubber layer which is formed from solid rubber, the foamed rubber can absorb the expansion of the solid rubber layer, thereby eliminating occurrence of bulge and thus enabling application of high pressure (not lower than about 3 kgf/cm$^2$) for further stabilization of contact.

Moreover, the foamed rubber layer has a discrete bubble structure in which bubbles are not connected to one another (discontinuous bubbles), the foamed rubber layer has an increased strength in the shearing direction, thereby enabling stable image formation.

Figure 15:
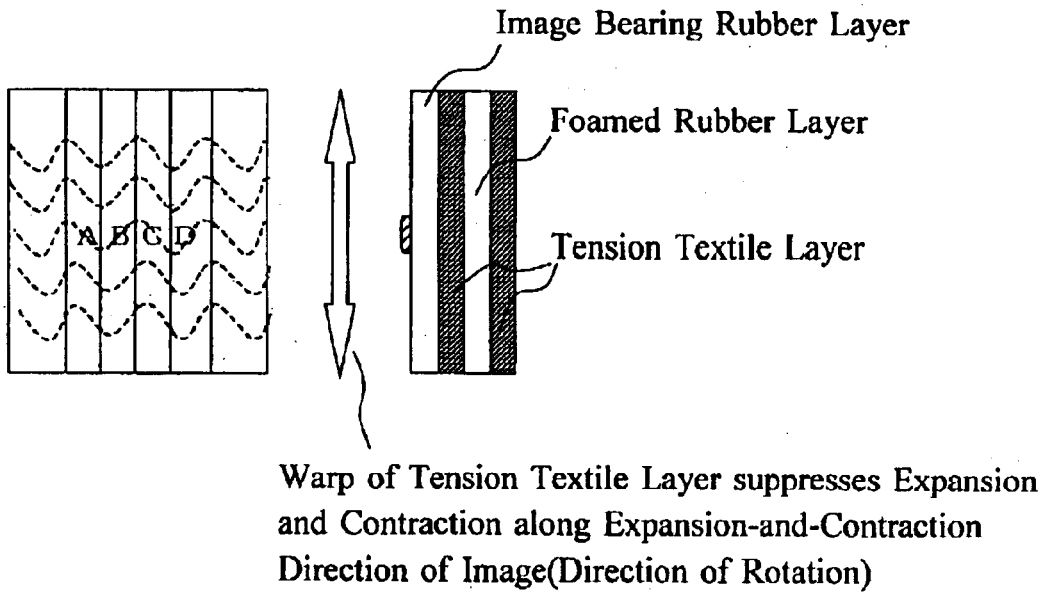
FIG. 15 is a view showing an intermediate transfer body in which a foamed rubber layer is sandwiched between tension textile layers.

FIG. 15 shows an intermediate transfer body in which a foamed rubber layer is sandwiched between tension textile layers. This structure enhances the yield strength of the foamed rubber layer in the shearing direction, thereby enabling stable formation of an image.

Figure 16:
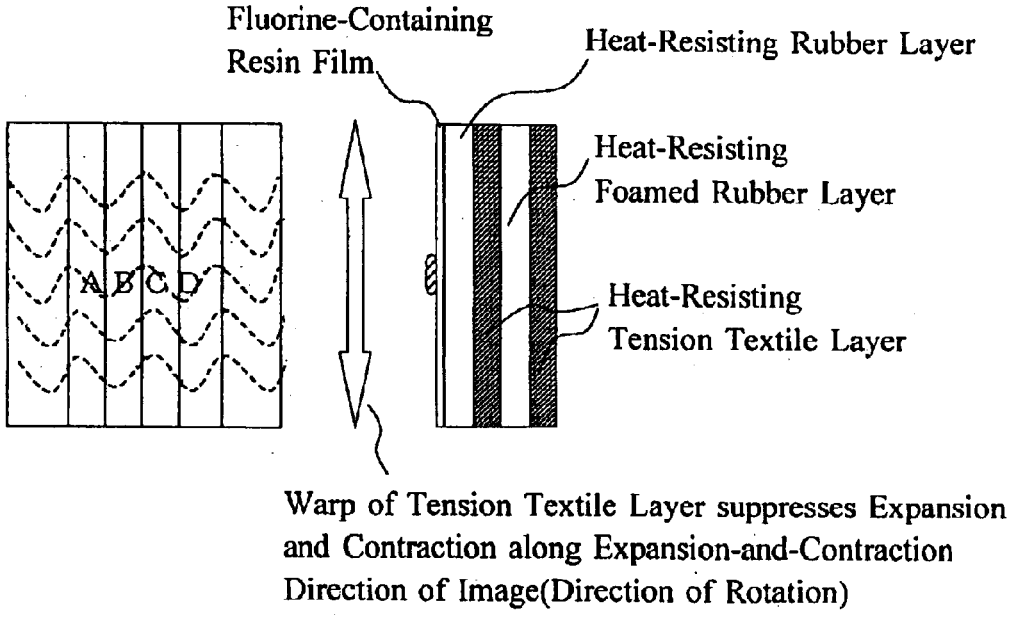
FIG. 16 is a view showing an intermediate transfer body including a fluorine-containing resin film.

FIG. 16 shows an intermediate transfer body including a fluorine-containing resin film. The tension textile layer, the aforementioned image bearing rubber layer, and the foamed rubber layer are formed from respective heat-resisting materials that allow firing of a fluorine-containing resin (e.g., PFA). Through formation of a fluorine-containing resin film on the surface thereof, the intermediate transfer body exhibits low surface energy, which yields excellent transfer efficiency. Examples of materials that allow firing of a fluorine-containing resin (e.g., PFA) include heat-resisting fiber materials such as polyamide fiber and vinylon fiber; heat-resisting rubber materials such as silicone rubber, acrylic rubber, and NBR rubber; and heat-resisting foamed rubber materials such as silicone rubber, acrylic rubber, and NBR rubber.

Figure 17:
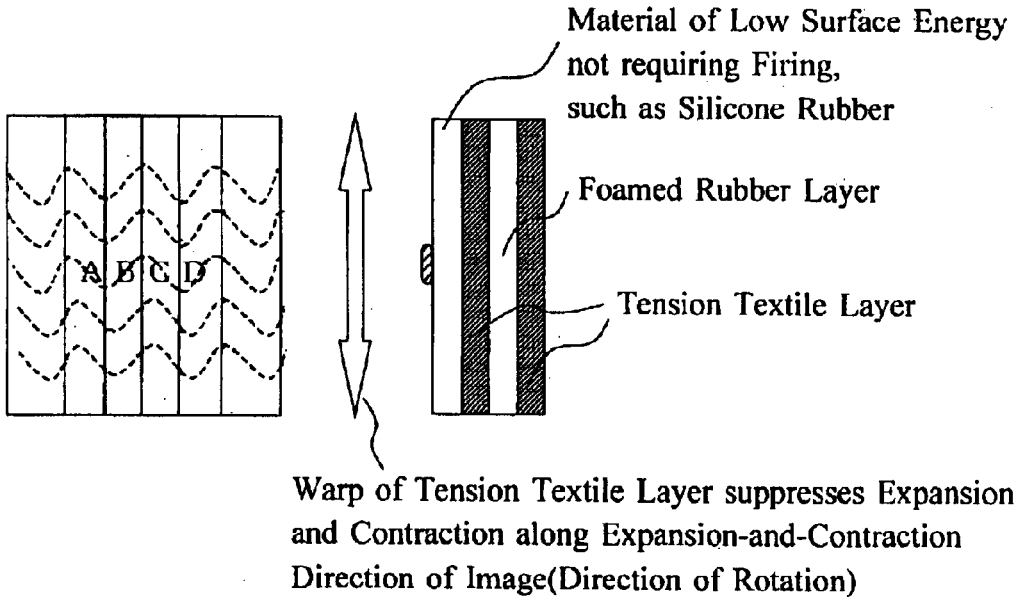
FIG. 17 is a view showing an intermediate transfer body in which an image bearing rubber layer is formed from a material that has low surface energy and does not require firing, such as silicone rubber.

FIG. 17 shows an intermediate transfer body in which the image bearing rubber layer is formed from a material that has low surface energy and does not require firing, such as silicone rubber. Even when the tension textile layer and the foamed rubber layer are formed from respective materials of low heat resistance, which are inexpensive, there can be provided an intermediate transfer body which exhibits low surface energy and thus yields excellent transfer efficiency.

Figure 18:
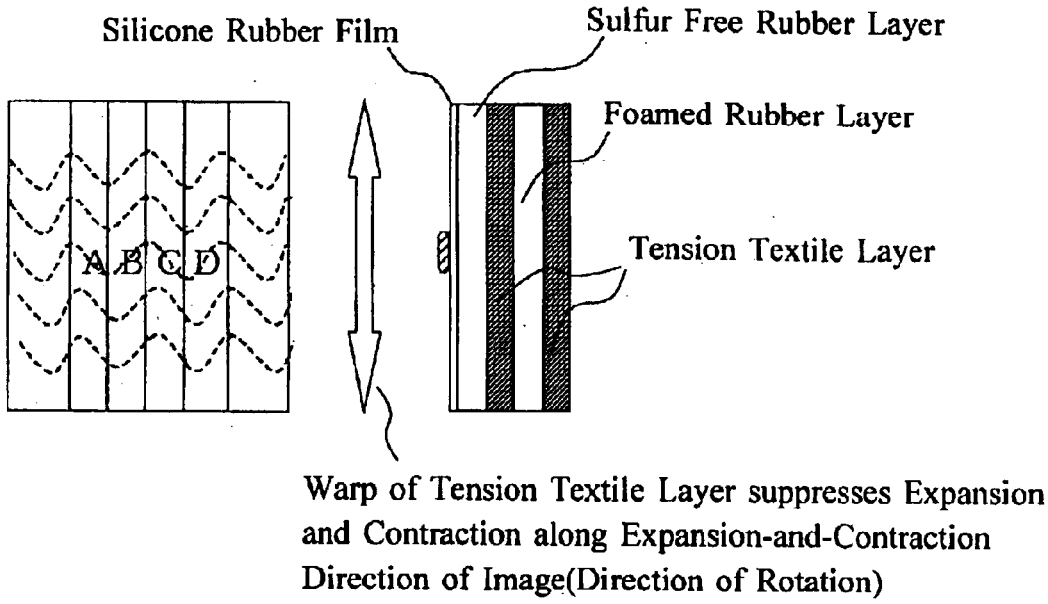
FIG. 18 is a view showing an intermediate transfer body in which sulfur, which potentially causes defective curing of silicone rubber, is eliminated from an image bearing rubber layer.

FIG. 18 shows an intermediate transfer body in which sulfur, which potentially causes defective curing of silicone rubber, is eliminated from the image bearing rubber layer. Employment of the sulfur free image bearing rubber layer enables use of a thin silicone rubber film (thickness in the order of tens of $\mu$m), which exhibits low surface energy. Since silicone rubber, which is expensive, is only used for forming a thin surface layer (thickness in the order of tens of $\mu$m), there can be provided an inexpensive intermediate transfer body which exhibits low surface energy and thus yields excellent transfer efficiency.

Figure 19:
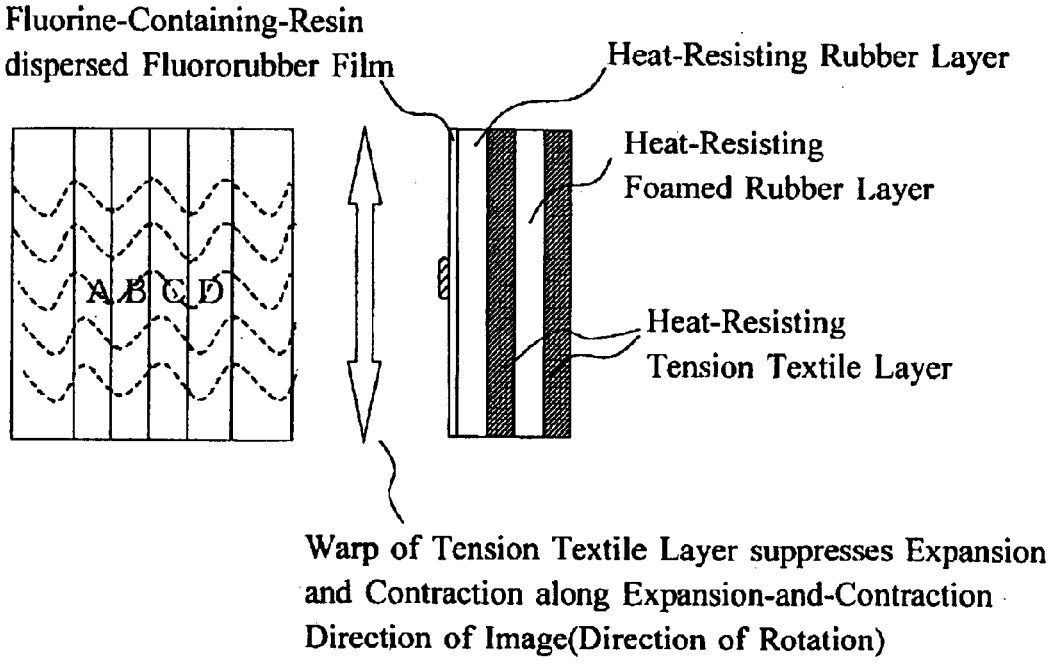
FIG. 19 is a view showing an intermediate transfer body in which the fluorine-containing resin film shown in FIG. 16 is a film of fluorine-containing-resin dispersed fluororubber.

FIG. 19 shows an intermediate transfer body in which the fluorine-containing resin film shown in FIG. 16 is a film of fluorine-containing-resin dispersed fluororubber (e.g., GLS-213, trade name of product of Daikin Industries, Ltd.). Through employment of the surface film, there can be provided an intermediate transfer body which exhibits excellent compliance with a rough surface of a rough medium.

Through employment of a process for semi-firing the fluorine-containing-resin dispersed fluororubber film (e.g., GLS-213, trade name of product of Daikin Industries, Ltd.) at a relatively low temperature of 100° C. to 200° C., there can be provided an inexpensive intermediate transfer body which exhibits low surface energy without use of expensive heat-resisting materials and excellent compliance with a rough surface of a rough medium.

When toner is to be moved by means of Coulomb force, electrical resistance must be imparted to an intermediate transfer body. The fluorine-containing-resin dispersed fluororubber film (e.g., GLS-213, trade name of product of Daikin Industries, Ltd.) varies in ion conductivity; i.e., electrical resistance, with firing temperature and firing time. Therefore, through adjustment of firing time and firing temperature over a range of 100° C. to 200° C., there can be provided an inexpensive intermediate transfer body which assumes an electrical resistance in the order of $10^8$ Ωcm to $10^{13}$ Ωcm suitable for inducing Coulomb force for moving toner and which exhibits low surface energy and excellent compliance with a rough surface of a rough medium.

Figure 20:
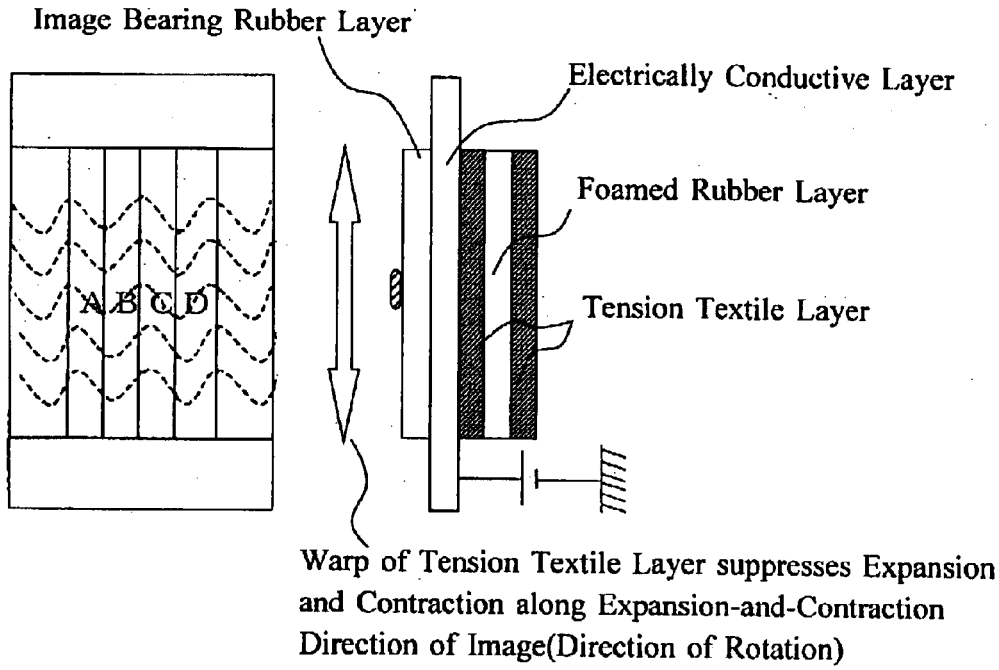
FIG. 20 is a view showing an intermediate transfer body including an electrically conductive layer (a low-resistance layer)

FIG. 20 shows an intermediate transfer body including an electrically conductive layer (a low-resistance layer). As described above, when toner is to be moved by means of Coulomb force, electrical resistance must be imparted to an intermediate transfer body. Generally, a textile layer is highly electrically insulative. In order to induce Coulomb force in a nip zone between the intermediate transfer body and a photosensitive drum, the image bearing rubber layer has an electrical resistance in the order of $10^8$ Ωcm to $10^{13}$ Ωcm, which is suitable for inducing Coulomb force for moving toner. Further, a low-resistance layer having an electrical resistance in the order of $10^7$ Ωcm or lower is formed under the image bearing layer in order to enable an electrode to be extended from an end portion of the intermediate transfer body. This structure enables induction of Coulomb force in the nip zone, thereby enabling stable transfer even when the textile layer is electrically insulative.

Figure 21:
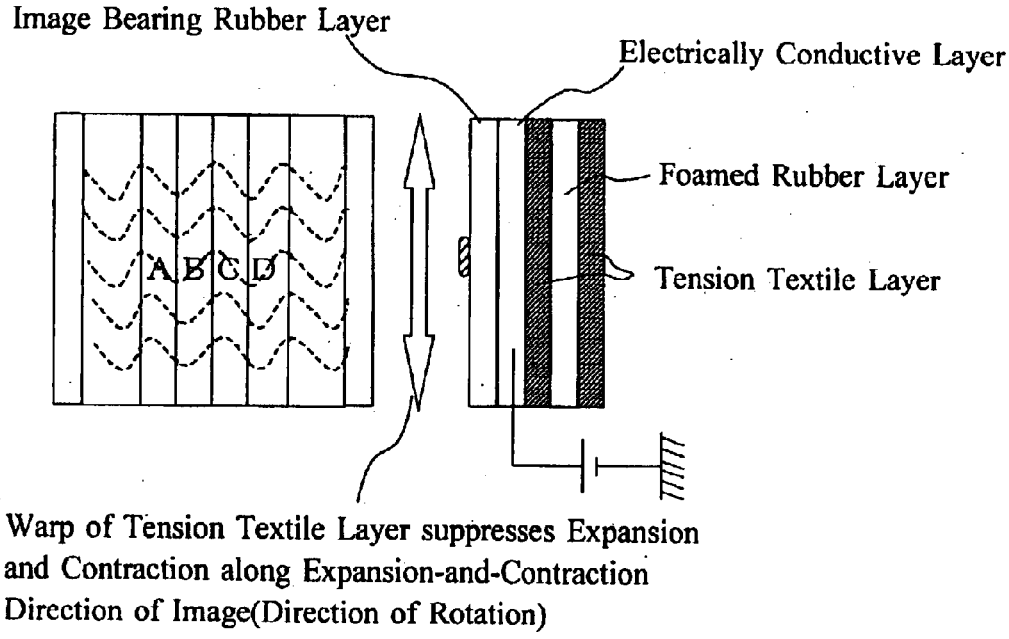
FIG. 21 is a view showing an intermediate transfer body in which an electrically conductive layer is formed so as to enable an electrode to be extended from a left-hand or right-hand end of the intermediate transfer body.

FIG. 21 shows an intermediate transfer body in which an electrically conductive layer is formed in order to enable an electrode to be extended from a left-hand or right-hand end portion of the intermediate transfer body. This structure allows the intermediate transfer body to assume a cylindrical form, whereby an image can be output continuously.

Figure 22:
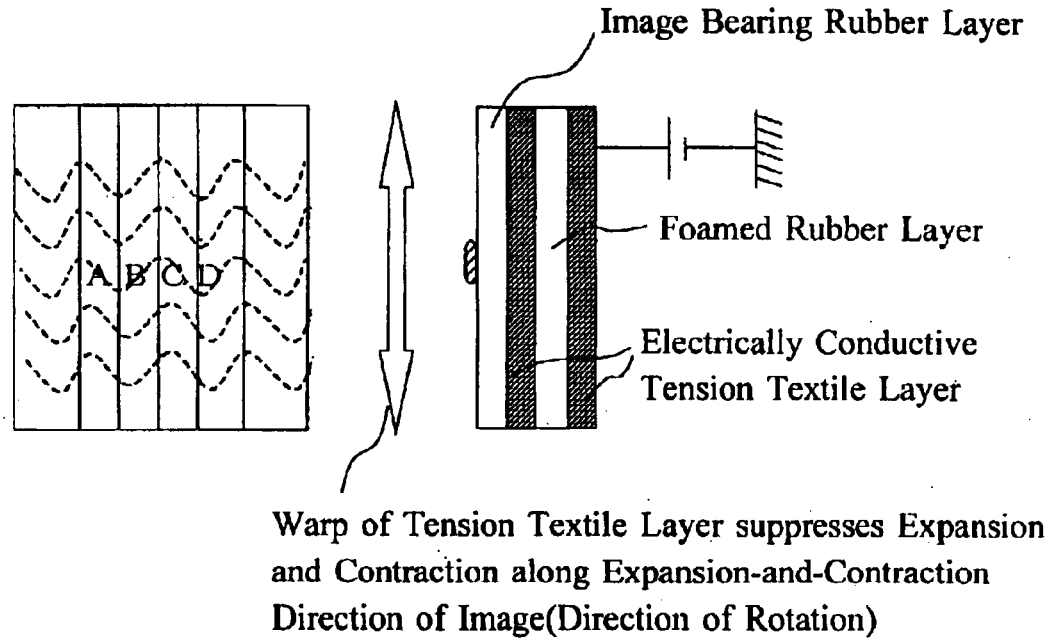
FIG. 22 is a view showing an intermediate transfer body in which a tension textile layer includes electrically conductive fibers.

FIG. 22 shows an intermediate transfer body in which a tension textile layer includes electrically conductive fibers. When toner is to be moved by means of Coulomb force, electrical resistance must be imparted to an intermediate transfer body. By use of electrically conductive fibers (e.g., carbon-containing fibers or stainless-steel-containing fibers) for forming the tension textile layer, an electrode can be extended directly from a layer (a core drum of the intermediate transfer roller) lying under a nip portion of the intermediate transfer roller. Thus, an electrically conductive layer becomes unnecessary; therefore, an inexpensive intermediate transfer body can be provided.

Generally, electrically conductive fibers such as carbon-containing fibers or stainless-steel-containing fibers are inferior to plain fibers in resistance to expansion and contraction and are expensive. Thus, by use of electrically conductive fibers as the weft and plain fibers as the warp, which is to be stretched, there can be provided an inexpensive intermediate transfer body which is free from deterioration in resistance to expansion and is electrically conductive.

The weft may include electrically conductive fibers and plain fibers such that a single electrically conductive fiber appears every several plain fibers, whereby the usage of electrically conductive fibers, which are expensive, is reduced. Thus, an inexpensive, electrically conductive intermediate transfer body can be provided.

Figure 23:
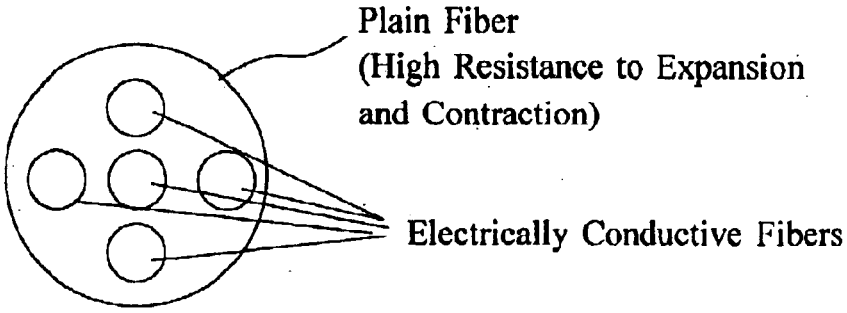
FIG. 23 is a sectional view showing a fiber which is formed such that a plurality of electrically conductive fibers are incorporated in a plain fiber.
Figure 24:
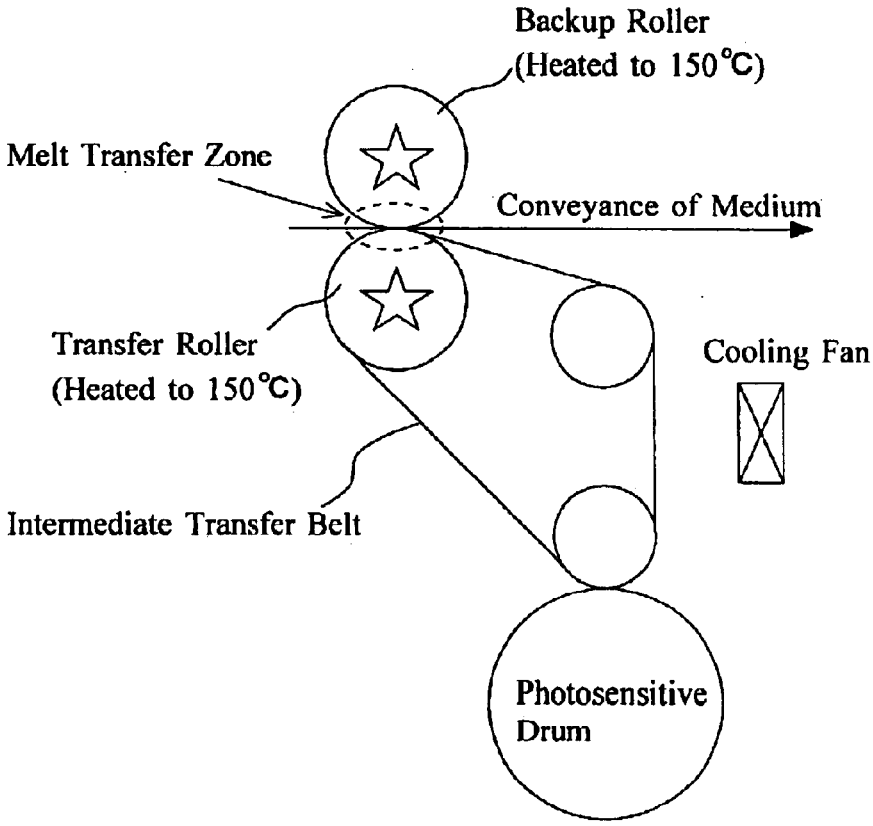
Fig. 24 Prior Art
FIG. 24 is a view showing a conventional melt transfer-and-fixation system where toner is melted, and the molten toner is transferred onto and fixed on paper by means of adhesion thereof.
Figure 25:
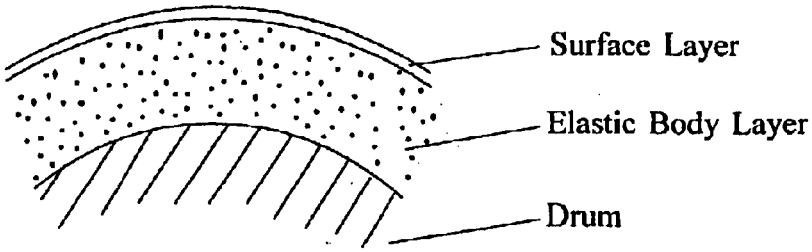
Fig. 25 Prior Art
FIG. 25 is a view showing a conventional structure of an intermediate transfer body.

FIG. 23 is a sectional view showing a single fiber which is formed such that a plurality of electrically conductive fibers are incorporated in a plain fiber. Even when the thus-formed fibers are used as the warp, there can be provided an electrically conductive intermediate transfer body which exhibits little deterioration in resistance to expansion and contraction.

The electrically conductive tension textile layer can be formed through impregnation of the textile with an electrically conductive coating of a solvent volatilization type. Since this structure does not need to use special electrically conductive fibers, there can be provided an inexpensive, electrically conductive intermediate transfer body which is free from deterioration in resistance to expansion and contraction.

This electrically conductive coating of a solvent volatilization type is applied after the surface layer of the intermediate transfer body is formed (after the intermediate transfer body having the surface layer formed thereon is manufactured). In the course of forming the surface layer, electrically conductive fibers are not handled; thus, special equipment is not required. The electrically conductive coating of a solvent volatilization type penetrates deep into fibers evenly by capillarity. Therefore, an inexpensive intermediate transfer body in which resistance is evenly distributed can be readily provided.

INDUSTRIAL APPLICABILITY

According to the present invention, the temperature of an intermediate transfer roller is set not higher than the withstand temperatures of members which come into contact with the intermediate transfer roller such as a photosensitive drum; toner cohesion and adhesion of toner to paper are increased through application of high pressure to thereby maintain excellent transfer efficiency; and paper is preheated before transfer so as to impart thermal energy required for fixation to paper, thereby securing sufficient fixation strength. Therefore, the members do not require cooling for protection from heat. Further, on the intermediate transfer roller having low surface energy; i.e., good releasability, toner cohesion does not drop and remains sufficiently great as compared with the surface energy of the intermediate transfer roller, thereby avoiding image thinning.

Also, according to the present invention, an intermediate transfer body includes a tension textile layer, which has undergone a stretching process effected in the direction of rotation of the intermediate transfer body, so as to enhance stiffness in expansion and contraction of the intermediate transfer body; and an image bearing layer is formed on the surface of the tension textile layer. Therefore, the intermediate transfer body can be manufactured at low cost while a function equivalent to that of a conventional intermediate transfer body, which uses an expensive material such as polyimide, is imparted thereto.

What is claimed is:

1. A transfer-and-fixation system for a liquid-development electrophotographic apparatus, in which a toner image produced through a development process of supplying a liquid toner onto an image bearing body bearing an electrostatic latent image is transferred from the image bearing body onto an intermediate transfer body and then transferred from the intermediate transfer body onto a printing medium by use of a backup roller in a transfer-and-fixation zone, wherein the intermediate transfer body includes a tension textile layer, which has undergone a stretching process effected in a direction of rotation of the intermediate transfer body, so as to enhance stiffness in expansion and contraction of the intermediate transfer body, and an image bearing layer is formed on a surface of the tension textile layer, wherein the intermediate transfer body and the backup roller are pressed against each other at a high pressure ranging from 10 $kg/cm^2$ to 60 $kg/cm^2$, and wherein no heating means is provided in the transfer-and-fixation zone, and the printing medium is preheated to a temperature required for transfer and fixation before the printing medium reaches the transfer-and-fixation zone.

2. A transfer-and-fixation system for a liquid-development electrophotographic apparatus as described in claim 1, wherein the image bearing layer is an elastic image bearing rubber layer.

3. A transfer-and-fixation system for a liquid-development electrophotographic apparatus as described in claim 2, wherein a foamed rubber layer is formed under the image bearing rubber layer.

4. A transfer-and-fixation system for a liquid-development electrophotographic apparatus as described in claim 2, wherein sulfur, which potentially causes defective curing of silicone rubber, is eliminated from the image bearing rubber layer, and a thin film of silicone rubber is formed on a surface of the image bearing rubber layer.

5. A transfer-and-fixation system for a liquid-development electrophotographic apparatus as described in claim 2, wherein the image bearing rubber layer is formed to have an electrical resistance in the order of $10^8$ Ωcm to $10^{13}$ Ωcm, which is suitable for inducing Coulomb force for moving toner; and a low-resistance layer having an electrical resistance in the order of $10^7$ Ωcm or lower is formed under the image bearing layer in order to enable an electrode to be extended from an end portion of the intermediate transfer body.

6. A transfer-and-fixation system for a liquid-development electrophotographic apparatus as described in claim 1, wherein the tension textile layer is formed by use of electrically conductive fibers in order to enable an electrode to be extended directly from a layer lying under a nip portin of the intermediate transfer body.

7. A transfer-and-fixation system for a liquid-development electrophotographic apparatus, in which a toner image produced through a development process of supplying a liquid toner onto an image bearing body bearing an electrostatic latent image is transferred from the image bearing body onto an intermediate transfer body and then transferred from the intermediate transfer body onto a printing medium by use of a backup roller in a transfer-and-fixation zone, wherein resin for use in the liquid toner has a softening temperature not higher than withstand temperatures of members other than the intermediate transfer body such as a photosensitive drum, and the intermediate transfer body is provided with heating means for heating the intermediate transfer body to a temperature not lower than the softening temperature of the resin and not higher than the withstand temperatures of the other members, and wherein the printing medium is preheated to a temperature required for transfer and fixation before the printing medium reaches the transfer-and-fixation zone.

8. A transfer-and-fixation system for a liquid-development electrophotographic apparatus as described in claim 7, wherein bias is applied between the intermediate roller and the backup roller in a direction along which toner can move.

9. A transfer-and-fixation system for a liquid-development electrophotographic apparatus as described in claim 7, wherein by means of varying preheating temperature or preheating time for the printing medium on the basis of the thickness of the printing medium, the optimum thermal energy is applied to the printing medium.

10. A transfer-and-fixation system for a liquid-development electrophotographic apparatus as described in claim 9, wherein a table which lists thermal conductivities of different types of printing media is stored, and the preheating temperature or the preheating time is corrected with reference to the table.

11. A transfer-and-fixation system for a liquid-development electrophotographic apparatus as described in claim 7, wherein the intermediate transfer body includes a tension textile layer, which has undergone a stretching process effected in a direction of rotation of the intermediate transfer body, so as to enhance stiffness in expansion and contraction of the intermediate transfer body, and an image bearing layer is formed on a surface of the tension textile layer.

12. A transfer-and-fixation system for a liquid-development electrophotographic apparatus as described in claim 11, wherein the image bearing layer is an elastic image bearing rubber layer.

13. A transfer-and-fixation system for a liquid-development electrophotographic apparatus as described in claim 12, wherein a foamed rubber layer is formed under the image bearing rubber layer.

14. A transfer-and-fixation system for a liquid-development electrophotographic apparatus as described in claim 12, wherein sulfur, which potentially causes defective curing of silicone rubber, is eliminated from the image bearing rubber layer, and a thin film of silicone rubber is formed on a surface of the image bearing rubber layer.

15. A transfer-and-fixation system for a liquid-development electrophotographic apparatus as described in claim 12, wherein the image bearing rubber layer is formed to have an electrical resistance in the order of $10^5$ Ωcm to $10^{13}$ Ωcm, which is suitable for inducing Coulomb force for moving toner; and a low-resistance layer having an electrical resistance in the order of $10^7$ Ωcm or lower is formed under the image bearing layer in order to enable an electrode to be extended from an end portion of the intermediate transfer body.

16. A transfer-and-fixation system for a liquid-development electrophotographic apparatus as described in claim 11, wherein the tension textile layer is formed by use of electrically conductive fibers in order to enable an electrode to be extended directly from a layer lying under a nip portion of the intermediate transfer body.

* * * * *

UNITED STATES PATENT AND TRADEMARK OFFICE

CERTIFICATE OF CORRECTION

PATENT NO. : 6,785,501 B2
DATED : August 31, 2004
INVENTOR(S) : Hironaga Hongawa et al.

It is certified that error appears in the above-identified patent and that said Letters Patent is hereby corrected as shown below:

Column 11,
Line 2, change “portin” to -- portion --.

Column 12,
Line 26, change “$10^5$” to -- $10^8$ --.

Signed and Sealed this

Tenth Day of May, 2005

JON W. DUDAS
*Director of the United States Patent and Trademark Office*